US007581355B2

(12) United States Patent
Smith

(10) Patent No.: US 7,581,355 B2
(45) Date of Patent: Sep. 1, 2009

(54) GUTTER LEVEL DEVICE

(76) Inventor: Randy Smith, 11845 CR C, Wauseon, OH (US) 43567

( * ) Notice: Subject to any disclaimer, the term of this patent is extended or adjusted under 35 U.S.C. 154(b) by 0 days.

(21) Appl. No.: 11/947,158

(22) Filed: Nov. 29, 2007

(65) Prior Publication Data

US 2009/0139152 A1 Jun. 4, 2009

(51) Int. Cl.
*E04D 13/00* (2006.01)

(52) U.S. Cl. ..... 52/11; 52/12; 52/15

(58) Field of Classification Search ..... 52/11, 52/12, 15; 248/48.1, 48.2
See application file for complete search history.

(56) References Cited

U.S. PATENT DOCUMENTS

| | | | | | |
|---|---|---|---|---|---|
| 2,024,348 | A | * | 12/1935 | Feltman | 248/48.2 |
| 2,784,687 | A | * | 3/1957 | Hovey | 52/11 |
| 3,296,749 | A | * | 1/1967 | Cotter | 52/11 |
| 3,752,428 | A | * | 8/1973 | Trostle et al. | 248/48.2 |
| 3,913,284 | A | | 10/1975 | Hall | |
| 4,019,290 | A | | 4/1977 | Manty | |
| 4,271,643 | A | | 6/1981 | Sweers | |
| 4,432,518 | A | * | 2/1984 | Navarre | 248/48.2 |
| 4,622,785 | A | * | 11/1986 | Miller | 52/11 |
| 4,713,915 | A | * | 12/1987 | Sweers | 52/11 |
| 4,745,657 | A | * | 5/1988 | Faye | 16/226 |
| 5,067,675 | A | * | 11/1991 | Brant | 248/48.2 |
| 5,845,435 | A | * | 12/1998 | Knudson | 52/11 |
| 5,960,591 | A | * | 10/1999 | Schluter | 52/11 |
| 6,254,039 | B1 | * | 7/2001 | Zimmerman | 248/48.2 |
| 6,260,307 | B1 | * | 7/2001 | Richardson | 52/11 |
| 6,460,811 | B1 | | 10/2002 | Miller | |
| 6,658,796 | B1 | | 12/2003 | Higgins | |
| 6,935,074 | B2 | | 8/2005 | Gramling | |
| 6,993,871 | B2 | * | 2/2006 | Richard et al. | 52/11 |
| 7,082,723 | B2 | | 8/2006 | Gramling | |
| 2005/0144851 | A1 | | 7/2005 | Gramling | |
| 2006/0053696 | A1 | | 3/2006 | Gramling | |

* cited by examiner

*Primary Examiner*—Richard E Chilcot, Jr.
*Assistant Examiner*—Mark R Wendell
(74) *Attorney, Agent, or Firm*—Fraser Clemens Martin & Miller LLC; J. Douglas Miller

(57) ABSTRACT

A gutter level device for leveling a gutter against a pitched fascia board is provided. The gutter level device includes a clip adapted to attach to a rear wall of the gutter. A selectively formable arm is coupled to a first end of the clip and adapted to bend to a first desired angle. The arm is further adapted to substantially match the pitch of the fascia board. A method for leveling the gutter with the gutter level device is also provided.

20 Claims, 2 Drawing Sheets

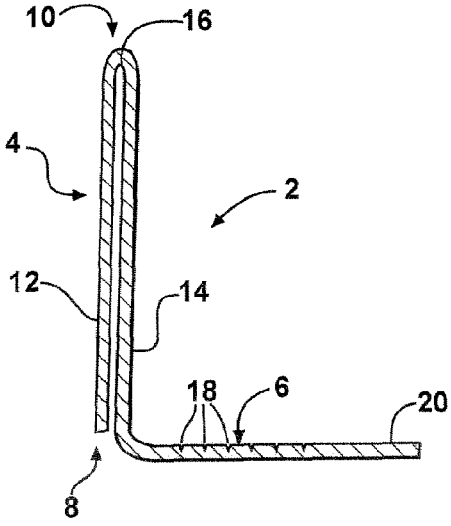
FIG - 1
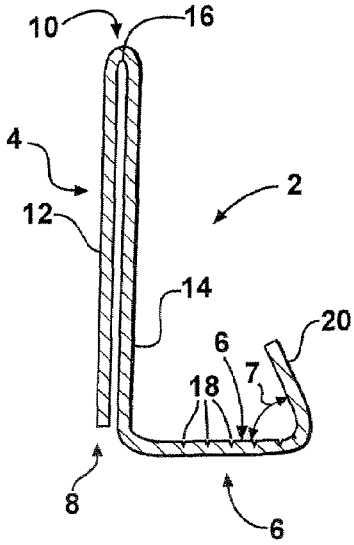
FIG - 2
FIG - 3
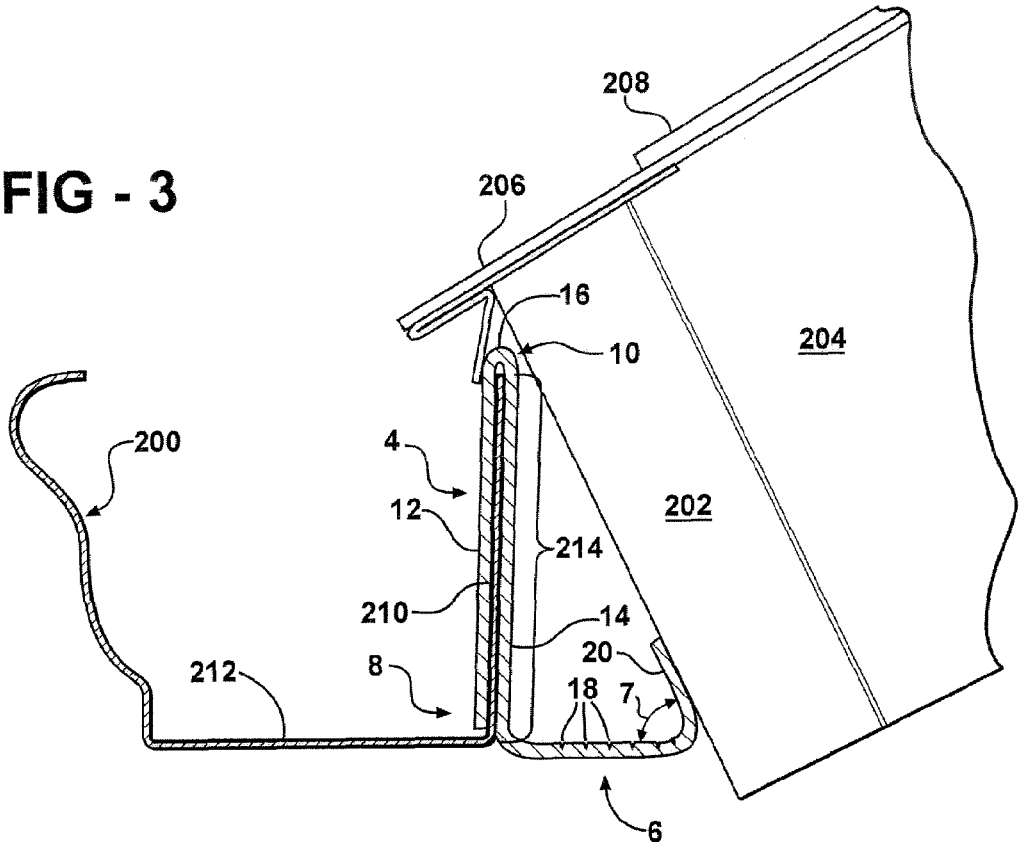

GUTTER LEVEL DEVICE

FIELD OF THE INVENTION

The present disclosure relates to a gutter leveling system and method, and, more particularly, to a device for leveling a gutter against a pitched fascia board.

BACKGROUND OF THE INVENTION

Channeling of rain water away from a building is a well known practice in the building art. Gutters systems are commonly added to buildings, such as houses, for channeling purposes. Gutters are troughs that channel water from an eave of a building, i.e., the horizontal lower edge of a roof, to a downspout. The downspout is essentially a drainpipe that drains water from the gutter. The gutter is a critical component of a building, because the gutter militates against moisture damage by channeling water off the roof and away from the foundation.

Traditionally, the gutter has been attached by nailing the gutter directly to the building. Building contractors often use a spike and ferrule system in which a narrow, tubular ferrule is placed between a front and a rear face of the gutter. The ferrule disposes the front face at a uniform distance in relation to the rear face. A spike or long nail is then punched through the outside of the front face of the gutter, through the ferrule and the back face of the gutter, and into a fascia board of the building. Gutter hangers, such as spacer plates having prepunched nail holes, and the like are also known in the art for attaching gutters to buildings.

The fascia board in a variety of building designs, particularly in older designs, may have a pitch associated therewith. A gutter attached to the pitched fascia board, without additional support, tends to free float on the fascia board. When rainwater and other materials are captured and pool in the gutter, the front face of the gutter may then tilt towards the ground. The weight of the pooled material in the gutter also creates a moment at the point of insertion of the nail, resulting in a force pulling the gutter away from the fascia board. Further, the pulling of the gutter away from the fascia allows water to run and collect behind the gutter. The water, in combination with periods of adverse weather, high winds, and the like, may undesirably affect the integrity of the fascia and pull the gutter further away from the fascia. Water running behind the fascia may also pool at the base of the building and undesirably affect foundation integrity.

It is known in the art to employ gutter straps, for example, secured to the gutter and nailed to the roof, to militate against a free floating of the gutter on the pitched fascia board. Gutter clips that fit between the gutter and the wall of a building to support the gutter are also known. For example, in U.S. Pub. App. No. 2006/0053696, a gutter clip having removable segments which permit the gutter clip to be modified for placement against buildings incorporating both straight and slanted fascia is described. Gutter clips of the art typically have first and second portions of different dimensions that clip to a gutter wall. However, the known gutter clips result in undesirable stresses and may result in cracking and a shorter useful lifespan of the gutter. Known gutter clips may also lack flexibility in placing a pitch on the gutter itself due to the aforementioned limitations in the clip dimensions.

There is a continuing need for a gutter clip that levels the gutter against a pitched fascia board and which is readily adapted for various fascia angles. Desirably, the gutter clip also facilitates the implementation of a gutter pitch and leverages the inherent strengths of the gutter design in militating against a tilting of the gutter and a pulling away of the gutter from the fascia board.

SUMMARY OF THE INVENTION

In concordance with the instant disclosure, a gutter clip that levels the gutter against a pitched fascia board, is readily adapted for various fascia angles, facilitates the implementation of a gutter pitch, and leverages the inherent strengths of the gutter design in militating against a tilting of the gutter and a pulling away of the gutter from the fascia board, is surprisingly discovered.

In one embodiment, a gutter level device for leveling a gutter against a pitched fascia board includes a clip adapted for attachment to a rear wall of the gutter. The gutter level device also includes a selectively formable arm coupled to a first end of the clip and adapted to bend to a first desired angle. The first desired angle substantially matches the pitch of the fascia board and allows the gutter level device to maintain the gutter in a substantially upright, level position when used.

In another embodiment, the gutter level device includes the clip adapted for attachment to the rear wall of the gutter, the clip having a first end and a second end. The clip includes a first vertical portion and a second vertical portion disposed adjacent one another. The first and second vertical portions have substantially the same length and are adapted to sandwich the rear wall of the gutter therebetween. The first and second vertical portions also militate against a degradation of the gutter with weathering. The gutter level device further includes the selectively formable arm integrally formed with the clip at the first end thereof. The selectively formable arm is adapted to bend to the first desired angle and substantially match the pitch of the fascia board. The arm maintains the gutter in the substantially upright position. The selectively formable arm also has a plurality of pitch lines indicating where the arm should be bent to match the pitch of the fascia board.

In a further embodiment, a method for leveling the gutter against the pitched fascia board includes the steps of: providing the gutter having the rear wall; providing a building having the pitched fascia board; and providing the gutter level device. The method further includes the steps of: determining a pitch of the fascia board; bending the selectively formable arm to substantially match the pitch of the fascia board; attaching the gutter level device to the gutter by disposing the clip over the rear wall of the gutter; and installing the gutter on the building, the gutter level device disposed between the gutter and the pitched fascia board.

DRAWINGS

The above, as well as other advantages of the present disclosure, will become readily apparent to those skilled in the art from the following detailed description, particularly when considered in the light of the drawings described hereafter.

FIG. 1 is a side elevational view of a gutter level device according to an embodiment of the present invention;

FIG. 2 is a side elevation view of the gutter level device shown in FIG. 1 having a first desired angle to match a fascia board pitch;

FIG. 3 is a fragmentary, side elevational view of the gutter level device of FIGS. 1 and 2 disposed between a fascia board and a gutter of a building.

DETAILED DESCRIPTION OF THE INVENTION

Figure 4:
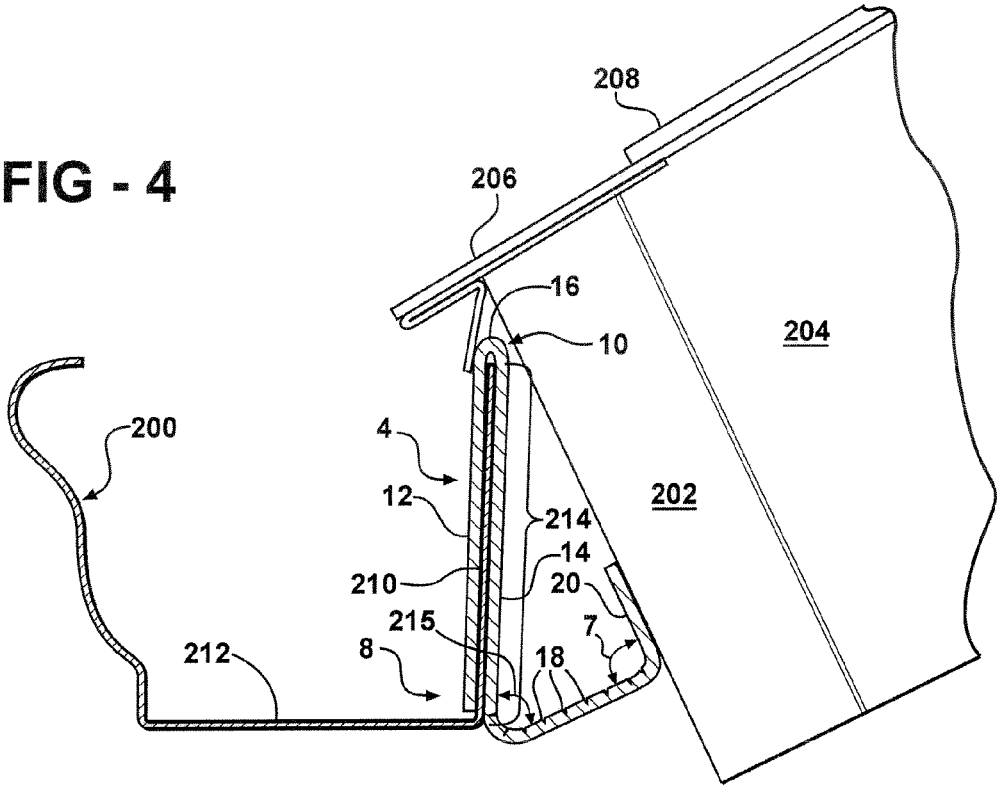
FIG. 4 is a fragmentary, side elevational view of the gutter level device of FIGS. 1 and 2 disposed between a fascia board and a gutter of a building, the gutter level device having a first desired angle and a second desired angle.

The following description is merely exemplary in nature and is not intended to limit the present disclosure, application, or uses. It should also be understood that throughout the drawings, corresponding reference numerals indicate like or corresponding parts and features. In respect of the methods disclosed, the steps presented are exemplary in nature, and thus, are not necessary or critical.

As shown in FIGS. 1 and 2, the present disclosure includes a gutter level device 2 having a clip 4 and a selectively formable arm 6. The clip 4 has a first end 8 and a second end 10. The selectively formable arm 6 is coupled to the first end 8 of the clip 4. The selectively formable arm 6 is adapted to bend to a first desired angle 7. As a nonlimiting example, the clip 4 may be integrally formed with the arm 6, such as by forming one of a sheet and a wire.

In one embodiment, the gutter level device 2 includes a first vertical portion 12 and a second vertical portion 14. The first and second vertical portions 12, 14 are disposed adjacent one another. Each of the first and second vertical portions 12, 14 have substantially equal lengths. The gutter level device 2 may also include a substantially u-shaped portion 16 disposed at the second end 10 of the clip 4. The u-shaped portion 16 may couple the first vertical portion 12 with the second vertical portion 14. It should be appreciated that other shaped portions, for example, including one or more angles, may also be suitable for coupling the first vertical portion 12 with the second vertical portion 14 to form the clip 4.

The selectively formable arm 6 of the present disclosure may include a plurality of pitch lines 18. At least one of the pitch lines 18 may be marked with an indicia, such as a numeral indicating a desired pitch. The plurality of pitch lines 18 may be formed as desired, for example, with a durable ink application or other suitable marking techniques. The plurality of pitch lines 18 may include one or more scores in the arm 6. It should be understood, however, that the scores 6 are for purpose of marking and are not formed in the arm to a depth where the arm 6 would break upon application of a bending force.

The plurality of pitch lines 18 are used to indicate a bending point of the arm 6 to match the first desired angle 7. For example, as illustrated best in FIG. 2, the selectively formable arm 6 may have an end portion 20 that is bent upwardly at one of the pitch lines 18 and toward the second end 10 of the clip 4. The first desired angle 7 of the arm 4 may thereby be achieved.

Materials and dimensions of the gutter level device 2 may be selected so that the arm 6 is formable upon application of a suitable bending force. The suitable bending force is generally greater than a force the arm 6 will experience in end use, but one which could be achieved under manual manipulation, for example, with a tool such as pliers. The gutter level device 2 thereby substantially retains the first desired angle 7 during the useful lifetime of the gutter level device 2. As a nonlimiting example, the arm may be formed from at least one of a malleable metal, a malleable polymer, and a malleable composite material. In a particular embodiment, the gutter level device 2 is formed from aluminum or an alloy thereof. It should be understood that the material selected may have a coating to resist weathering of the gutter level device 2. The coating may be a polymeric coating, for example. A suitable thickness of the material forming the gutter level device 2, and particularly the arm 6, may be selected as desired.

Referring now to FIG. 3, the gutter level device 2 of the present disclosure is illustrated attached to a gutter 200 and supporting the gutter 200 against a fascia board 202 of a building 204. The fascia board 202 is generally disposed beneath an eave 206 of the building's roof 208. In particular, the clip 4 of the gutter level device 2 is adapted to attach to a rear wall 210 of the gutter 200. The selectively formable arm 6 of the gutter level device 2 is bent to the first desired angle 7 to substantially match a pitch of the fascia board 202. The arm 6 is also bent to provide a set distance between the fascia board 202 and the gutter 200. The gutter level device 2 thereby maintains the gutter 200 in a level and upright position, regardless of the pitch associated with the fascia board 202.

The gutter 200 includes a rear wall 210 and a bottom wall 212. The rear wall 210 is "clipped" to the gutter level device 2. As a nonlimiting example, the rear wall 210 may be disposed between the first vertical portion 12 and the second vertical portion 14. The first and second vertical portions 12, 14 are adapted to sandwich the rear wall 210 and support the gutter 200.

In a further embodiment, the lengths of the first and second vertical portions 12, 14 are substantially the same as a height 214 of the rear wall 210. A skilled artisan should appreciate that the first and second vertical portions 12, 14, having substantially the same length as the height 214 of the rear wall 210 supports the gutter 200 and militates against a degradation thereof in use. It is understood in the art that the bottom wall 212 of the gutter 200 is inherently the strongest portion of the gutter 200. As the gutter 200 experiences adverse weathering, such as high winds and the like, and as rainwater and other materials are captured and pool in the gutter 200, a moment may occur on the gutter 200. The first and second vertical portions 12, 14 cause the resulting moment 200 to occur on the inherently stronger bottom wall 212 instead of along the rear wall 210. A degradation of the rear wall 210 of the gutter 200, for example, by cracking, is thereby militated against.

With reference to FIG. 4, the gutter level device 2 of the present disclosure may also be adapted to bend the formable arm 6 to a second desired angle 215, for example, substantially adjacent the second vertical portion 214. The second desired angle 215 may be used in conjunction with the first desired angle 7 to allow the gutter level device 2 to support the gutter 200 in a substantially upright and level position. As a nonlimiting example, the arm 6 with both the first desired angle 7 and the second desired angle 215 may substantially match the pitch of the pitched fascia board 202. The second desired angle 215 is particularly advantageous when used with the pitched fascia board 202 having a length insufficient for the first desired angle 7 of the arm to come into contact therewith. The bending force suitable for bending the arm 6 to the first desired angle 7 may also be applied to bend the arm 6 and produce the desired second angle 215.

The present disclosure also includes a method for leveling the gutter 200 against the pitched fascia board 202. The method first includes the steps of providing the gutter 200 having the rear wall 210, providing the building 204 having the pitched fascia board 202; and providing the gutter level device 2. The pitch of the fascia board 202 is then determined, for example, by measuring or estimating the pitch according to methods known in the art. The arm 6 of the gutter level device 2 is then bent at the desired pitch line 18 and to the first desired angle 7. The desirable angle 7 substantially matches the pitch of the fascia board 202. The gutter level device 2 is then attached to the gutter 200, for example, by disposing the clip 4 over the rear wall 210 of the gutter 200. The gutter 200 is then installed on the building 204 according to known methods. The gutter level device 2 is disposed between the gutter 200 and the pitched fascia board 202.

In a further embodiment, wherein the arm 6 has the end portion 20 and the plurality of pitch lines 18, the step of bending the arm 6 includes bending the arm 6 at one of the pitch lines 18 indicated to match the pitch of the fascia board 202. The arm 6 is bent until the end portion 20 of the arm 6 is substantially aligned with the second end 10 of the clip. As a nonlimiting example, the step of bending the arm 6 may be performed by manual manipulation. The arm 6 may be bent to the first desired angle 7 with a tool, such as channel-lock pliers, for example. One of ordinary skill in the art should understand that other suitable means for bending the arm 6 to the first desired angle 7 may be employed as desired.

The step of installing the gutter 200 may include placing the gutter 200 on a horizontal pitch along the fascia board 202. The horizontal pitch may be employed so that rain water draining into the gutter 200 from the roof 208 will only flow in one direction such as toward a downspout (not shown) in fluid communication with the gutter 200. It should be appreciated that more than one gutter level device 2 having the first and second vertical portions 12, 14, particularly of substantially the same length, may each be disposed over the rear wall 210 of the gutter 200 to different extents. The horizontal pitch of the gutter 200 may thereby be facilitated with the gutter level device 2 of the present disclosure. It should also be appreciated that the ability of the gutter level device 2 to facilitate the horizontal pitch is particularly advantageous over gutter clips of the art that do not employ vertical portions having substantially the same length.

Advantageously, the gutter level device 2 may be used in conjunction with conventional gutter attaching devices, such as straps, brackets and hangers, for example, spike-and-ferrule hangers. It is surprisingly found that the gutter clip 2 militates against not only a pulling away of the gutter 200 from the fascia board 202 with extensive weathering, but also a cracking of the gutter 200 under the same conditions. The durability of the gutter 200 may thereby be improved with the employment of the gutter level device 2.

While certain representative embodiments and details have been shown for purposes of illustrating the invention, it will be apparent to those skilled in the art that various changes may be made without departing from the scope of the disclosure, which is further described in the following appended claims.

What is claimed is:

1. A gutter level system, comprising:

a gutter having a rear wall with a thickness; and a gutter level device for leveling the gutter against a pitched fascia board, the gutter level device including, a clip adapted for attachment to the rear wall of the gutter, the clip having a first end and a second end, the clip including a first vertical portion and a second vertical portion disposed adjacent one another, the first and second vertical portions having substantially the same length, a distance between the first and second vertical portions substantially the same as the thickness of the rear wall of the gutter, the first and second vertical portions in contact with the rear wall to sandwich substantially the entire rear wall of the gutter therebetween and militate against a degradation of the gutter with weathering, and a selectively formable arm integrally formed with the clip at the first end thereof, the selectively formable arm adapted to be bent to a desired angle to form an end portion substantially matching a pitch of the pitched fascia board and to maintain the gutter in a substantially upright position, the angled end portion placed against the pitched fascia board, the selectively formable arm including a plurality of pitch lines indicating a bending point where the arm should be bent to match the pitch of the pitched fascia board.

2. The gutter level system of claim 1, wherein the lengths of the first and second vertical portions are substantially the same as a height of the rear wall of the gutter.

3. The gutter level system of claim 1, wherein the clip includes a u-shaped portion at a second end of the clip, the u-shaped portion coupling the first vertical portion with the second vertical portion.

4. The gutter level system of claim 1, wherein the desired angle is selected to maintain the gutter in a substantially upright position.

5. The gutter level system of claim 1, wherein at least one of the pitch lines includes an indicia formed thereon.

6. The gutter level system of claim 1, wherein at least one of the pitch lines is formed by a score in the arm.

7. The gutter level system of claim 1, wherein at least one of the clip and the arm is formed from one of a sheet and a wire.

8. The gutter level system of claim 7, wherein the one of the sheet and the wire has a thickness that facilitates the bending of the arm.

9. The gutter level system of claim 1, wherein the arm is formed from at least one of a malleable metal, a malleable polymer, and a malleable composite material.

10. The gutter level system of claim 1, wherein the arm is adapted to be bent to a second desired angle, the second desired angle disposed adjacent the second vertical portion.

11. The gutter level system of claim 1, wherein the pitch lines of the gutter level device do not cause a breaking of the selectively formable arm upon a bending thereof.

12. The gutter level system of claim 1, further including a weather-resistant coating disposed on the gutter level device.

13. A method for leveling a gutter against a pitched fascia board, comprising the steps of:

providing the gutter having a rear wall with a thickness;

providing a gutter level device having a clip with a first end and a second end, the clip adapted for attachment to a rear wall of the gutter, the clip including a first vertical portion and a second vertical portion disposed adjacent one another, the first and second vertical portions having substantially the same length, a distance between the first and second vertical portions substantially the same as the thickness of the rear wall of the gutter, the first and second vertical portions adapted to contact the rear wall to sandwich substantially the entire rear wall of the gutter therebetween and militate against a degradation of the gutter with weathering, and a selectively formable arm coupled to the first end of the clip and adapted to be bent to a desired angle to form an end portion substantially matching a pitch of a fascia board of a building, the selectively formable arm including a plurality of pitch lines indicating a bending point where the arm should be bent to match the pitch of the pitched fascia board;

determining a pitch of the fascia board;

bending the selectively formable arm to substantially match the pitch of the fascia board;

attaching the gutter level device to the gutter by disposing the clip over the rear wall of the gutter; and attaching the gutter with the gutter level device to the building, the gutter level device disposed between the gutter and the pitched fascia board with the angled end portion placed against the pitched fascia board.

14. The method of claim 13, wherein the step of bending the selectively formable arm includes bending the arm at the pitch line indicated to match the pitch of the fascia board until the end portion of the arm is substantially aligned with the second end of the clip.

15. The method of claim 13, wherein the step of bending the selectively formable arm is performed with channel-lock pliers.

16. The method of claim 13, wherein the step of attaching the gutter on the building includes attaching the gutter to the fascia board with a spike and a ferrule hanger.

17. The method of claim 13, wherein a plurality of the gutter level devices is provided.

18. The method of claim 17, wherein the step of installing the gutter includes placing the gutter on a horizontal pitch along the fascia board.

19. The method of claim 14, wherein the step of bending the selectively formable arm includes bending the arm substantially adjacent the second vertical portion to cause the end portion to contact the pitched fascia board and support the gutter in a substantially upright and level position.

20. The method of claim 14, wherein the step of providing the gutter level device causes a moment to occur on a bottom wall of the gutter instead of the rear wall of the gutter during weathering.

* * * * *

UNITED STATES PATENT AND TRADEMARK OFFICE

CERTIFICATE OF CORRECTION

PATENT NO. : 7,581,355 B2
APPLICATION NO. : 11/947158
DATED : September 1, 2009
INVENTOR(S) : Randy Smith It is certified that error appears in the above-identified patent and that said Letters Patent is hereby corrected as shown below:

Title Page, item [75] Inventor: should read --Randy Smith, 11485 CR C, Wauseon, OH (US) 43567--

Signed and Sealed this

Twentieth Day of October, 2009

David J. Kappos

David J. Kappos
*Director of the United States Patent and Trademark Office*